United States Patent [19]

Seib

[11] 4,011,482

[45] Mar. 8, 1977

[54] ELECTRIC CIRCUIT CONTROL SYSTEM USING EXCLUSIVE "OR" GATE

[76] Inventor: James N. Seib, R.R. 1, Williams, Ind. 47470

[22] Filed: Aug. 28, 1975

[21] Appl. No.: 608,509

[52] U.S. Cl. ..... 315/361; 307/115; 307/252 B; 315/362; 307/216

[51] Int. Cl.[2] ..... H05B 37/02; H05B 39/06

[58] Field of Search ..... 315/361, 209 R, 291, 315/194, 199, 320, 322, 362; 307/216, 114, 252 B, 305, 252 C, 252 UA, 239, 252 N, 252 Q, 252 T, 115, 157

[56] References Cited

UNITED STATES PATENTS

| | | | |
|---|---|---|---|
| 3,418,489 | 12/1968 | Platzer, Jr. | 307/252 B |
| 3,646,365 | 2/1972 | Thorsoe et al. | 307/252 Q |
| 3,825,153 | 7/1974 | Patrick et al. | 307/352 B |
| 3,913,023 | 10/1975 | Dolch | 307/216 |

*Primary Examiner*—Eugene R. LaRoche
*Attorney, Agent, or Firm*—Woodard, Weikart, Emhardt & Naughton

[57] ABSTRACT

A circuit is disclosed which is suitable for controlling lighting in a building from a multiple number of points. AC current to light bulbs is controlled by a triac which in turn is controlled by the output of a series of exclusive OR gates. The output of each exclusive OR gate is connected to one input of an adjacent exclusive OR gate except that the output of the last exclusive OR gate of the series is connected to control the input to the triac. Switches connecting to the remaining inputs of each of the exclusive OR gates each can independently determine energization or de-energization of the light bulbs.

15 Claims, 1 Drawing Figure

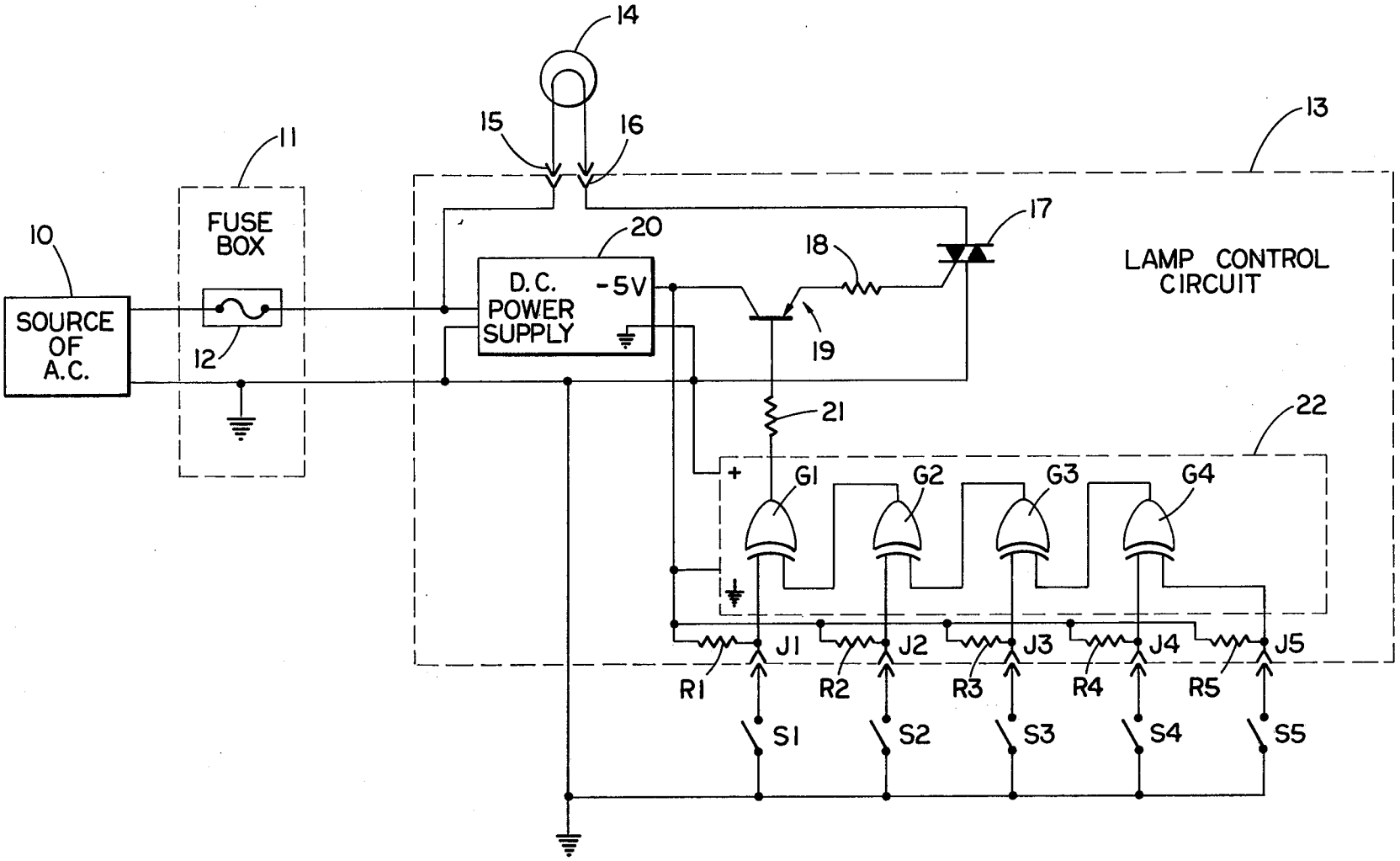
LAMP CONTROL CIRCUIT
D.C. POWER SUPPLY
-5V
FUSE BOX
SOURCE OF A.C.
10
11
12
13
14
15
16
17
18
19
20
21
22
G1
G2
G3
G4
J1
J2
J3
J4
J5
R1
R2
R3
R4
R5
S1
S2
S3
S4
S5

ELECTRIC CIRCUIT CONTROL SYSTEM USING EXCLUSIVE "OR" GATE

BACKGROUND OF THE INVENTION

1. Field of the Invention

The invention relates to a switching system which is adaptable to include a plurality of switches for selectively controlling the application of electrical power to an electrical load.

2. Description of the Prior Art

Numerous clever circuits have been developed in the past for controlling the connection of an electrical supply source to its load. However, generally the wiring of homes and buildings uses conventional switches in line with the circuit from the AC power source to the electrical load. Where light fixtures in a home are to be switched on and off the wiring is of heavy gauge copper or aluminum and runs from the source of the AC power through one or more switches to the electrical load (which would be the light fixture). This results in an expensive wiring installation since the wiring to each switch and each switch itself must be sufficient to carry the total power needed by the electrical load. Such switches need relatively heavy duty contacts and incorporate high voltages which present some risk of shock in the event of failure or improper installation.

It has been known to replace this previously described system with one incorporating relays which can latch either on or off. The individual switches used to control the relays can be operated from a large number of points at low AC voltages with relatively small gauge wire and relatively light duty switch contacts. Normally the control switches do not operate in the conventional toggle fashion to which persons are accustomed but rather have to be operated in one direction to turn the lights on and in another direction to turn the lights off in a momentary contact type of arrangement.

U.S. Pat. No. 3,481,489 to Platzer, Jr. discloses a third type of prior art switching circuit. This circuit incorporates a triac to control the current through a light bulb. The triac is controlled by two separate switches, each of which are single-pole single-throw switches. The switches control AC current which passes through separate windings on a transformer. When the state of either of the switches is changed the state of the conduction of the triac is changed. This provides independent control of the light from two separate locations. This technique, however, is not easily applied to situations which require control at more than two points. Further, transformers of the type disclosed tend to be either expensive or require a relatively large amount of current to achieve reliable control. It may further be noted that in the circuit of Platzer, Jr. U.S. Pat. No. 3,418,489 that high voltage from the source of AC power does appear at the switches.

SUMMARY OF THE INVENTION

The invention relates to electrical load control circuitry particularly suitable for controlling electric lights in homes and businesses and which includes a first switch for controlling DC signals to one input of an exclusive OR gate and means for readily connecting a second switch in a manner such that operation of the second switch would change the state of the second input of the exclusive OR gate. The output of the exclusive OR gate is a DC signal which connects to an AC control device for controlling power applied to the electrical load, possibly a light fixture.

The invention can be made appropriate for connecting any number of control switches by the series connection of exclusive OR gate such that the output of each exclusive OR gate connects to the input of each adjacent exclusive OR gate and the output of the last exclusive OR gate in the series being connected to control the AC power. Switches may then be connected to any of the unconnected inputs of the exclusive OR gates to control the power to the load. These switches operate on low voltage DC and thereby may use very inexpensive switch contacts and very inexpensive connecting wire. Rigid building codes for high voltage AC wiring may be avoided.

Since the control is DC, noise or transients on the control lines do not have any effect or produce interference in the operation of the circuits. Very importantly, interruption of power does not effect the state of the light after recovery. The invention can be produced extremely economically by the incorporation of integrated circuits into the lamp fixture or into the electrical outlet into which a lamp is to be plugged. Since the circuit can be connected to any number of switches with inexpensive wire, modifications of electrical systems after they are installed becomes extremely straightforward. Installation time can be substantially reduced since very low voltages and low currents involved in switching do not require the expensive wiring associated with conventional high voltage wiring to switches.

BRIEF DESCRIPTION OF THE DRAWING

The drawing illustrates a circuit incorporating the invention. This circuit provides for control of a lamp from five separate switch locations.

DESCRIPTION OF THE PREFERRED EMBODIMENT

Referring in particular to the figure, there is illustrated an electrical load control circuit for remotely selectively energizing or de-energizing an electrical load. The circuit includes a source of AC 10 which provides a 120 volt AC supply source at 60 Hertz. The source of AC 10 provides power through a fuse box 11 which includes a fuse 12. The source of AC 10 connects through fuse 12 to one side of lamp 14 which has a lamp base 15 inserted into socket 16. The lamp 14 serves as an electrical load consuming 25 watts of power when voltage is applied through a completed circuit. Lamp 14 is a conventional 25 watt incandescent light bulb, but higher powered light bulbs could equally be used in the circuit of the preferred embodiment.

The current through lamp 14 is controlled initially by a triac 17 which is preferably a G. E. SC51D. The triac in turn is controlled through a 120 ohm resistor 18 by transistor 19 which is a 2N3906 transistor. Transistor 19 receives a minus 5 volts applied to its collector from DC power supply 20. DC power supply 20 connects to the source of AC and converts this source of AC to minus 5 volts for use by transistor 19 and an integrated circuit package (IC) 22. IC 22 is a TI SN7486 and includes four exclusive OR gates. Power supply 20, transistor 19, resistor 18 and triac 17 provide a DC operated AC control means for controlling the power applied to lamp 14 from the source of AC 10. This DC operated AC control means is itself operated through resistor 21 by the output of exclusive OR gate G1.

Exclusive OR gate G1 has a first and second input for producing a first DC signal in its one output state and a second DC signal in its other output state. Inherent in the definition of an exclusive OR gate is the fact that there will be one output state when both inputs are the same and a second output state when both inputs are different. Gates G2 through G4 are similar in operation to gate G1. One input of gate G1 is connected through connector J1 to switch S1. Switch S1 is a manually operable switch connected to control the first input of gate G1. Since the switch S1 connects an input of G1 to ground when closed and allows the input voltage to fall when opened (due to resistor R1), a change in the state of switch S1 will cause a change in the output of gate G1. Alternatively the resistors R1-R5 could be built internally into the IC 22.

Gate G2 has its output connected to the other input of gate G1. Therefore, when there is a change in the output of G2 there will also be a change in the output of G1. The output of G2 may be changed in a manner identical to that explained with regard to gate G1, with S2 providing the control of gate G2 in the manner that S1 provided the control of gate G1 and R2 functioning in the manner of R1. Connector J2 provides means for readily connecting the second manually operated switch to gate G2 to provide control thereof. Connector J2 is a solderless connector of conventional design which makes electrical connection by the mere insertion of the wire from S2 into the connector.

It can be noted that one side of each of the switches S1 through S5 connects to ground and the other side connects to an input of an exclusive OR gate. With this arrangement, only one wire needs to be connected from a switch to any particular lamp control circuit connector, a common ground being used to provide the other switch connection. This results in a minimum amount of wire being needed. Gate G3 and G4 are connected similarly to gates G2 and G1. It may be noted, however, that since gate G4 is the last gate in the series, that both of its inputs are used for connection of manually operated switches S4 and S5 thereto. Connectors J3-J5 are used to provide rapid connection of wires from manually operated switches S3-S5 to available inputs of gates G3-G4. S5 as shown could be replaced by the output of another IC similar to IC 22 to provide inputs for additional switches.

If desired, the above circuit can be modified to add additional features. A time delay network can be added between resistor 21 and transistor 19, if desired, to provide a lengthy delay in the extinguishing of lamp 14 as is sometimes desirable. In addition, the circuit could be modified to incorporate light dimming circuitry. While the above circuitry is most appropriate for use with electric lamps, it is apparent that it could equally be used with any electrical outlet to control any device plugged in that outlet. It is envisioned that the lamp control unit 13 will be built in one integrated piece to incorporate an outlet (such as a plug receptacle or a lamp socket) together with the associated AC control device and exclusive OR gates. IC 22 may be replaced by any equivalent integrated circuit which functions as a parity generator. The series arrangement of gates could equally well be replaced by a "Christmas Tree" arrangement of gates, with the output of two gates connecting to the input of another gate.

While there has been described above the principles of this invention in connection with a specific circuit, it is to be clearly understood that this description is made only by way of example and not as a limitation to the scope of the invention.

What is claimed is:

1. An electrical load control circuit for remotely selectively energizing or de-energizing an electrical load which comprises:

a. an AC supply source;
b. an electrical load;
c. a DC operated AC control means for controlling the power applied to said electrical load from said AC supply source;
d. a first exclusive OR gate circuit means having a first and second input and for producing a first DC signal in its one output state and a second DC signal in its other output state;
e. the output of said first exclusive OR gate circuit means being connected to operate said AC control means;
f. a first manually operable switch electrically connected to control the first input of said first exclusive OR gate circuit means so that operation of said switch will change the state of energization of said electrical load; and
g. means for readily connecting a second manually operable switch in a manner such that any operation of the second switch would change the state of said second input of said first exclusive OR gate circuit means.

2. The load control circuit of claim 1 in which said load includes an incandescent light.

3. The load control circuit of claim 2 in which said light is at least a 25 watt light and said AC supply source is about 120 volts at 60 Hertz.

4. The electrical load control circuit of claim 1 in which said means for readily connecting includes a second exclusive OR gate circuit means having a first and second input and for producing a first DC signal in its one output state and a second DC signal in its outer output state, the output of said second exclusive OR gate circuit means connecting to the second input of said first exclusive OR gate circuit means.

5. The electrical load control circuit of claim 4 which additionally includes a third exclusive OR gate circuit means having a first and second input and for producing a first DC signal in its one output state and a second DC signal in its other output state, the output of said third exclusive OR gate circuit means connecting to the second input of said second exclusive OR gate circuit means.

6. The circuit of claim 1 which additionally includes a second manually operable switch electrically connected to said means for readily connecting.

7. The load control circuit of claim 1 in which said AC supply source is about 120 volts at 60 Hertz and said load consumes at least 25 watts when power is applied to it.

8. The load control circuit of claim 7 in which said means for readily connecting includes a second exclusive OR gate circuit means having a first and second input and for producing a first DC signal in its one output state and a second DC signal in its other output state, the output of said second exclusive OR gate circuit means connecting to the second input of said first exclusive OR gate circuit means.

9. The load control circuit of claim 8 which additionally includes a third exclusive OR gate circuit means having a first and second input and for producing a first DC signal in its other output state, the output of said third exclusive OR gate circuit means connecting to the second input of said second exclusive OR gate circuit means.

10. The load control circuit of claim 9 which additionally includes a second manually operable switch electrically connected to said means for readily connecting.

11. The load control circuit of claim 10 in which said first, second and third exclusive OR gate circuit means include three integrated circuit exclusive OR gates combined together in a single package.

12. The load control circuit of claim 11 in which said DC operated AC control means includes a triac.

13. The load control circuit of claim 12 which additionally includes a third manually operable switch connected to one input of said third exclusive OR gate circuit means.

14. The load control circuit of claim 6 in which one side of said AC supply source is ground and one side of said first and second manually operable switches are electrically connected together and to ground.

15. In a building having an electrical outlet controlled from two separate locations with a manually operable switch located at each of the two locations, the building being supplied with an AC supply source of about 120 volts at 60 Hertz and having the ability to supply at least 25 watts of power to the electrical outlet, the improvement comprising a control circuit which includes:

a. a DC operated AC control means for controlling the power applied to said outlet from said AC supply source;

b. a first exclusive OR gate circuit means having a first and second input and for producing a first DC signal in its one output state and a second DC signal in its other output state;

c. the output of said first exclusive OR gate circuit means being connected to operate said AC control means;

d. one of the manually operable switches electrically connected to control the first input of said first exclusive OR gate circuit means so that operation of said switch will change the state of the output of said first exclusive OR gate circuit means; and e. the other of the manually operable switches electrically connected to control the second input of said first exclusive OR gate circuit means so that operation of said other switch will change the state of the output of said first exclusive OR gate circuit means.

* * * * *